US007406740B2

(12) United States Patent
Subramanian

(10) Patent No.: US 7,406,740 B2
(45) Date of Patent: Aug. 5, 2008

(54) DUSTING AND CLEANING DEVICE

(76) Inventor: Pallatheri Subramanian, 110 Cameron Dr., Hockessin, DE (US) 19707

( * ) Notice: Subject to any disclaimer, the term of this patent is extended or adjusted under 35 U.S.C. 154(b) by 0 days.

(21) Appl. No.: 11/532,619

(22) Filed: Sep. 18, 2006

(65) Prior Publication Data

US 2008/0066249 A1 Mar. 20, 2008

(51) Int. Cl.
*A47L 13/46* (2006.01)

(52) U.S. Cl. ..... 15/231; 403/109.1; 403/109.2

(58) Field of Classification Search ..... None
See application file for complete search history.

(56) References Cited

U.S. PATENT DOCUMENTS

| | | | | |
|---|---|---|---|---|
| 740,486 | A | 10/1903 | Tellerson | |
| 1,235,038 | A | 7/1917 | Klinka | |
| 1,244,592 | A | 10/1917 | Roo | |
| 1,291,131 | A | 1/1919 | Radel | |
| 1,367,293 | A | 2/1921 | Brandes | |
| 1,414,110 | A * | 4/1922 | Bocchio | 403/107 |
| 1,958,408 | A | 5/1934 | Jelliffee et al. | |
| 2,916,759 | A | 12/1959 | Smith | |
| 3,137,878 | A * | 6/1964 | Richards | 15/118 |
| 3,239,866 | A | 3/1966 | Czerniawski | |
| 3,452,383 | A | 7/1969 | Eichner | |
| 5,471,703 | A | 12/1995 | Niven | |
| 5,715,560 | A | 2/1998 | Banicki | |
| 5,845,917 | A * | 12/1998 | Huang | 280/47.371 |
| 5,983,435 | A | 11/1999 | Osborne | |
| 6,189,730 | B1 * | 2/2001 | McClymonds | 221/46 |
| 6,276,022 | B1 | 8/2001 | Gallacher | |
| 6,546,587 | B2 | 4/2003 | Christiansen | |
| 6,681,438 | B2 | 1/2004 | Newman et al. | |
| 2004/0154119 | A1 | 8/2004 | Bullock | |
| 2006/0046781 | A1 * | 3/2006 | Barfoed et al. | 455/557 |

* cited by examiner

*Primary Examiner*—David A Redding
(74) *Attorney, Agent, or Firm*—D. Austin Bonderer

(57) ABSTRACT

The invention is a cleaning device comprising of a shaft. The shaft has a hollow section and a lower end with a rim. The rim defines an opening at the bottom end of the shaft. The opening is located about the longitudinal axis and is in communication with the hollow section. The shaft also has one or more apertures that extend through the side of the shaft and are in communication with said hollow section. The shaft also has one or more slits that maybe in communication with the one or more apertures. The slit(s) run parallel to the longitudinal axis and may terminate before reaching the rim. The cleaning device is designed in such a way to easily allow a user to employ any flexible fabric or other suitable material in the cleaning device.

21 Claims, 4 Drawing Sheets

DUSTING AND CLEANING DEVICE

BACKGROUND

1. Field of the Invention

The invention relates to tools that employ paper towels, cloths, flexible materials designed for cleaning and/or other suitable fabric in the art of cleaning.

2. Description of the Prior Art

In today's households, many people employ cleaning devices that aid in using fabrics for cleaning and dusting. These cleaning devices allow the user to apply the cleaning fabric to the soiled area without having to awkwardly bend over to scrub the floor or use a stool to reach the ceiling. For example if one were to employ a fabric to clean the floor without such a cleaning device, that person would have to either bend over or get down on their hands and knees to clean the soiled floor. However, recent cleaning devices now allow the user to apply the cleaning fabric to the floor and other areas out of the users' reach.

Many of these cleaning devices require that the user purchase specific disposable fabric sheets to employ the device. These sheets can be much more expensive than just ordinary paper towels. They also do not provide for use of non-disposable cloths or ordinary rags. These cleaning devices do not allow for those who are environmentally conscious to use the devices, they cause more cost to the consumer and they are responsible for harm to the environment in the form of increased waste.

Many of theses devices are also of relatively complicated design with many moving parts. Manufacturing of the individual parts and assembling those parts into the final product takes time and increases cost. More parts of a device, moving and non-moving, increase the chances of malfunction. An increase in complexity comes with a decrease in reliability.

The current invention alleviates the stated deficiencies of the prior art. The invention allows users to employ paper towels, fabrics, non-disposable cloths and any fabric suitable for cleaning for dusting and cleaning without having to bend over to reach the floor or stand on a stool to reach the ceiling. It is also of simple design and operation, saving both time and money during manufacturing and use.

SUMMARY OF THE INVENTION

A cleaning device comprises of a shaft. The shaft comprises a hollow section and a lower end with a rim. The rim defines an opening at the proximate end of the shaft, and the opening is located about the longitudinal axis and is in communication with the hollow section. The shaft also has one or more apertures that extend through the side of the shaft and are in communication with said hollow section. The apertures maybe in direct communication with one of the one or more slits. The slit(s) run parallel to the longitudinal axis and may terminate before reaching the rim.

The design of the cleaning device allows the user to secure any fabric or cleaning material in the device and use that fabric or cleaning material for cleaning with greater ease than devices of the prior art. It enables the user to clean without having to apply pressure with their hands, lean over or reach up to get to spaces, use non disposable rags and/or have to purchase specific designed cleaning materials.

DETAILED DESCRIPTION OF THE INVENTION

Figure 1:
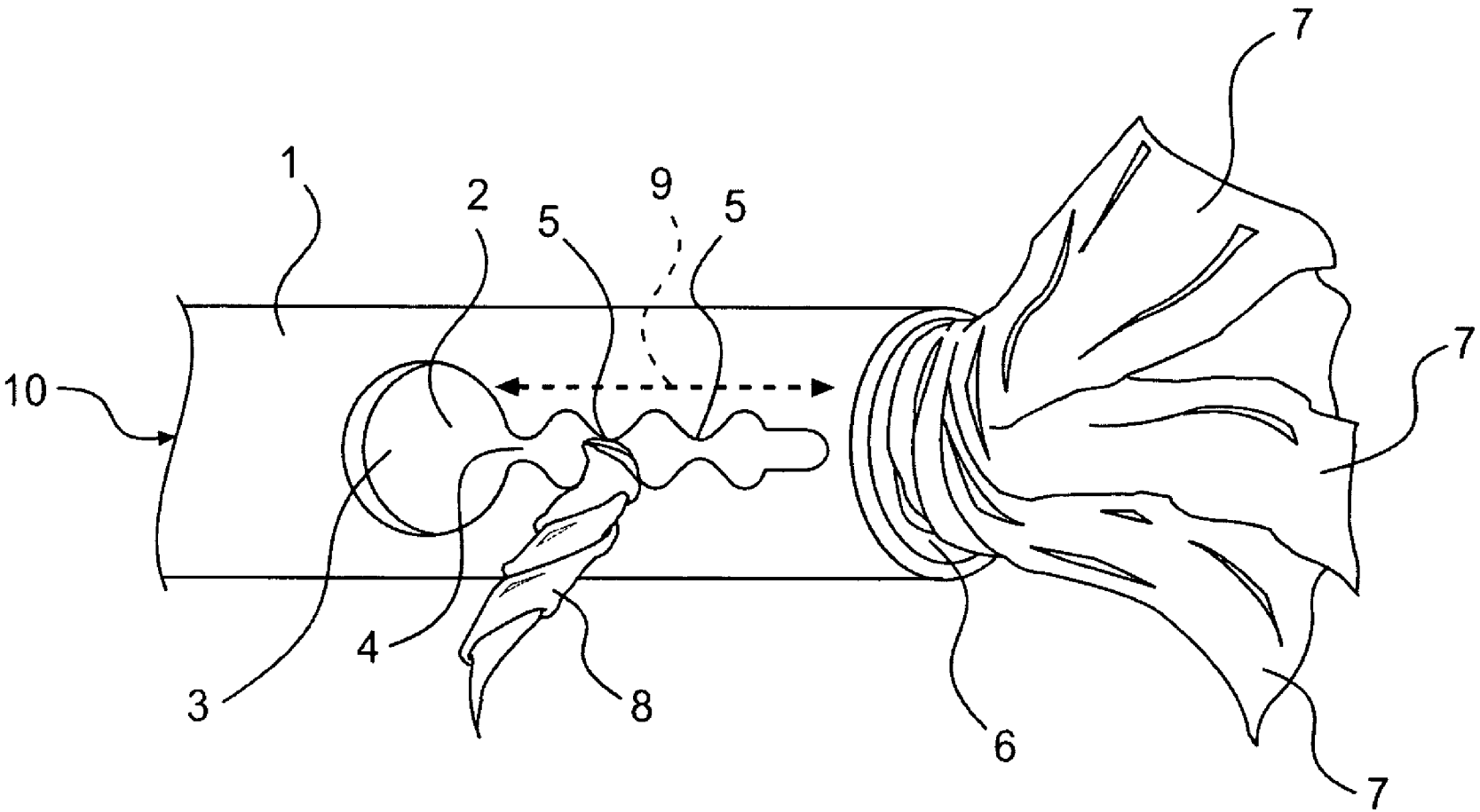
FIG. 1 shows an embodiment of the invention where the fabric is twisted and inserted through the bottom and locked in place solely by the frictional engagement with the projections.

An embodiment of the invention is shown in FIG 1. The embodiment has a shaft 1 with a handle end 10 for having a handle (not shown) and an open end 6 for receiving fabric 7. The open end is defined by the rim of shaft 1. The shaft 1 is at least hollow from the open end 6 to the two apertures 2 and 3. The shaft 1 also has one or more slits, illustrated as reference numeral 4, that run down the sides of the shaft 1 from the apertures 2 and 3 toward the open end 6 for a length 9. At least one of the apertures 2 and 3 has a slit 4. One or more apertures may have shape capable of accepting a finger. The slit(s) 4 may have projections 5 that are used to help secure the twisted end 8 of the fabric 7. Fabric 7 can include, but is not limited to: paper towels; terry cloths, rags, flexible materials designed for cleaning; wet wipes; any flexible material suitable for cleaning; or any combination thereof.

Figure 2:
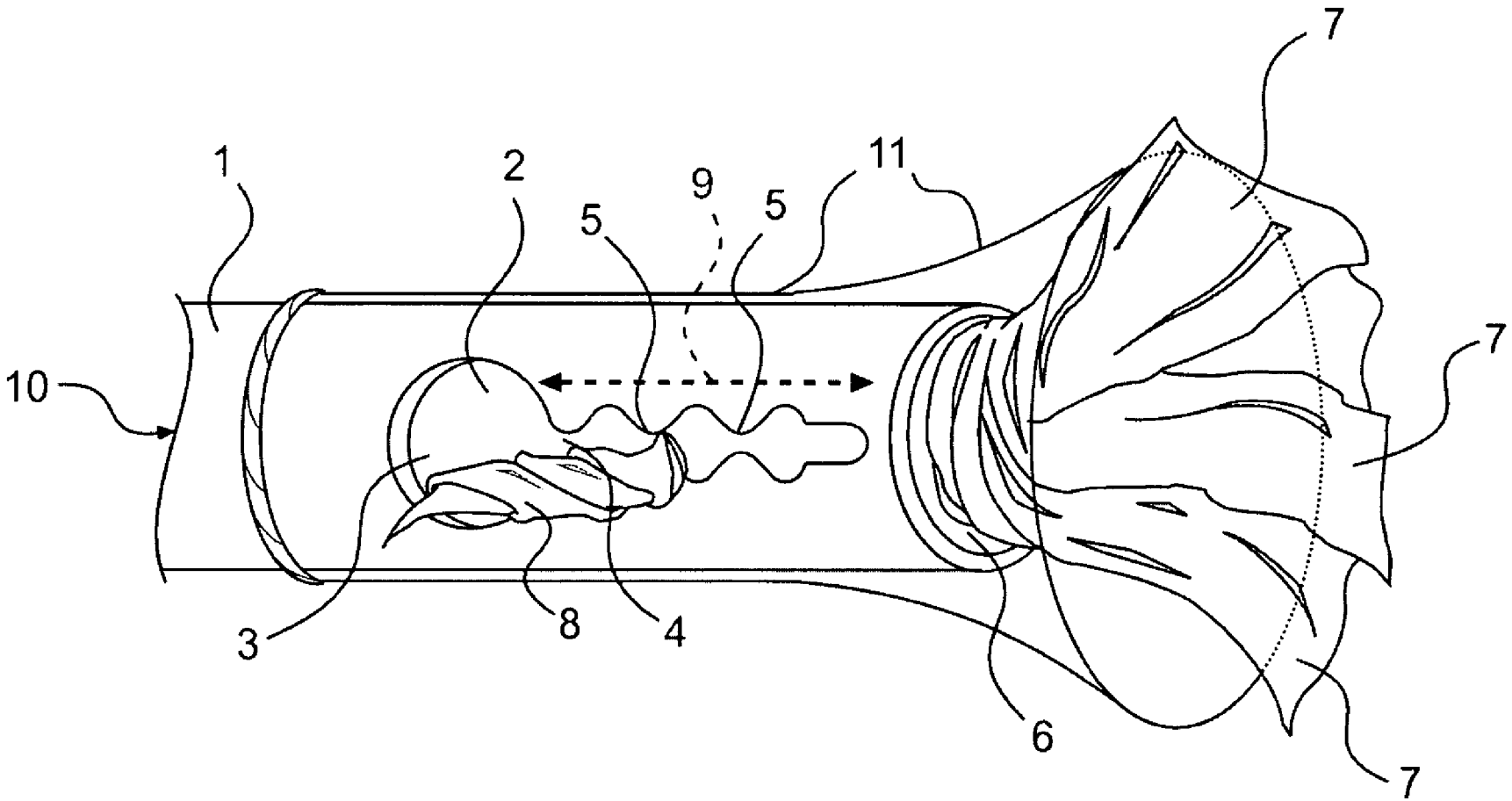
FIG. 2 shows an embodiment that employs a sleeve, in addition to the projections, help secure the fabric.

Another embodiment is shown in FIG. 2. This embodiment is closely related to that shown in FIG. 1, and the like parts are labeled as such. The difference between the two embodiments is the sleeve 11. The sleeve 11 will slide over lower part of the shaft after the fabric is inserted through the open end 6, through an aperture 2 or 3 and pulled down through a slit 4 and between the projections 5. The sleeve's 11 diameter will be larger than that of the lower part of the shaft 1 so that it will slide over the lower part of the shaft 1 and the twisted end 8 of the fabric 7. When the sleeve 11 is slid into the secured position, over the twisted end 8, it will further help secure the fabric to the shaft 1. The sleeve 11 can either slide completely off the shaft 1 or be designed in such a way that it can move along the shaft but prevent from coming entirely off. The sleeve 11 may also comprise of one or more parts that are secured about the shaft by any suitable means.

The sleeve 11 will be in the secured position when a portion of the sleeve 11 is secured over a portion of the aperture(s), 2 and/or 3, and/or over a portion of the slit(s) 4. The sleeve 11 can be secured by frictional engagement and/or mechanical means.

While the sleeve 11 is shown as having a conical end, any shape that will serve spread out and/or apply pressure to the fabric 7 when cleaning is contemplated. The sleeve 11 can be flexible or ridged, designed to fit specific applications such as cleaning corners and/or designed to spread out the pressure applied to the fabric 7. The sleeve 11 may also have a joint and a section that pivots about that joint.

The slits 4 and apertures 2 and 3 are shown in FIG. 1 and FIG. 2 to be on both sides of the shaft. However it is hereby disclosed that the embodiments can have two apertures and one slit or one aperture and one slit. Also, while it is shown in the figures that the slit 4 has projections, it is hereby disclosed that many means can be used to secure the twisted end 8 of the fabric 8. Those means include but not limited to projections that are jagged, a slit that starts to narrow at a certain point, a slit with a constant width, projections that are offset or any combination thereof.

In operation of the invention, the user will first select one or more sheets of fabric 7. For explanation purposes, the use of multiple paper towels will be discussed here with the embodiment shown in FIG. 2. The user would align the paper towels how they choose and then twist the sheets into a point as shown as the twisted end 8. The user would then push the twisted end 8 through the open end 6 so that the twisted end 8 would reach the apertures 2 and 3. The user would then push and/or pull the twisted end 8 through the apertures 2 and 3. The user may then pull the twisted end 8 up in order to pull more fabric 7 through the open end to increase the thickness of the cloth in the slit(s) 4. The user would then pull the twisted end 8 down through the slit 4 and pass the projections 5 so that the twisted end 8 would then become secure. The user would then move the sleeve 11 to the secured position, over the twisted end 8, to help secure the twisted end 8 of the fabric 7. The invention is then ready to use.

When the user wants to change out the paper towels, the user first slides the sleeve 11 out of the secured position, pulls up the twisted end 8 up through the projections 5 and the slit 4, and then pulls the twisted end 8, by the lower end of the fabric 7, back through the lower end 6. The user would then replace the fabric 7 and repeat the steps above.

In another embodiment with a sleeve 11, the sleeve will spread out and apply pressure to the fabric 7. For example, if the user where to use the cleaning device to clean the floor, the sleeve would spread out the fabric 7 and increase the area upon which force is being applied to the floor. This will increase the cleaning effectiveness of the device and help prevent tearing of the fabric 7.

When using a long version of the cleaning device, the user can use it to clean the floor or ceiling fans. When using a shorter version the user can use it to clean the tub or toilet. The uses of the cleaning device of various lengths and angles are obvious to one of ordinary skill in the art and within the sprit of the invention.

Figure 3:
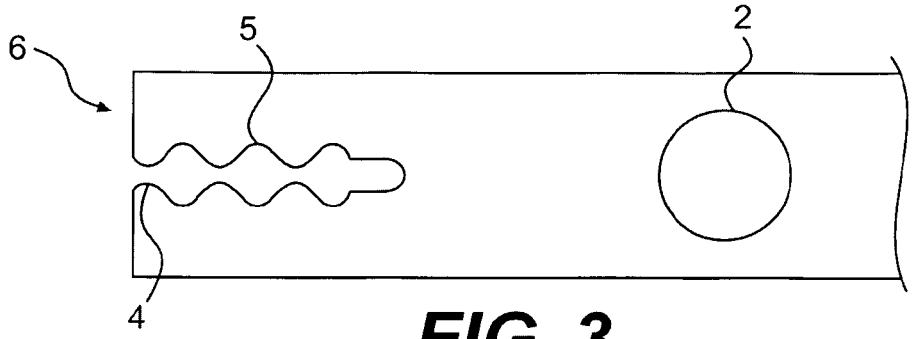
FIG. 3 shows one side of another embodiment designed to secure two ends of the fabric.
Figure 4:
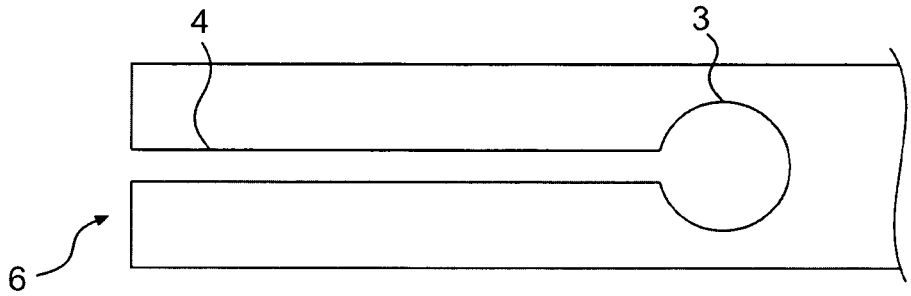
FIGS. 4 and 4*a* show different designs for the reverse side of the FIG. 3.
Figure 4A:
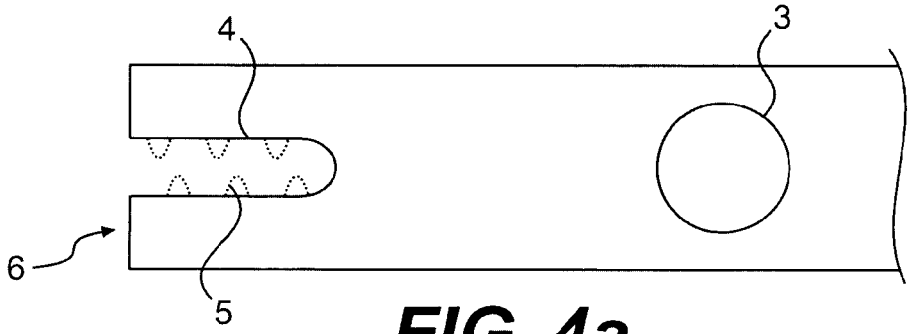
Figure 5:
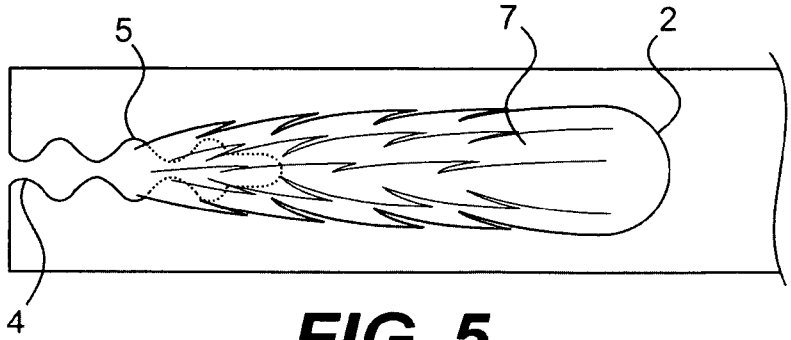
FIG. 5 shows how the fabric maybe secured in a taut postion.

In another embodiment of the invention the fabric 7 will be secured at two different locations. Referring to FIGS. 3-5, a shaft with an opened end 6 is shown. FIG. 3 shows the a first side of the embodiment and FIGS. 4 and 4*a* show alternative designs for the opposite side. The first side, FIG. 3, shows a slit 4 with projections 5 and an aperture 2. The second side, FIG. 4 and in the alternative FIG. 4*a*, shows a slit 4 and an aperture 3. The slit 4 may or may not intersect with the aperture 3. The slit may or may not have projections 5 (shown in FIG. 4*a*) or maybe of a constant or varying width as disclosed above. Any combination of slit length, shape with or without projections is hereby contemplated. This embodiment can have a handle that is transverse or along the shaft 1. This embodiment may or may not have a hollow end. At the very least slit 4 must extend through the shaft.

This embodiment allows for the fabric 7 to be secured at two separate locations. For the purposes of this example we will use multiple paper towels placed on top of one another and the fabric 7 and formed to have a twisted end 8. Once the twisted end 8 is inserted through the aperture 3 and out of aperture 2, the fabric 7 is drawn through the apertures to the point the desired resistance it created. The resistance will occur because of the thickness of the fabric 7 being pulled through the apertures. The user will then take the twisted end 8 (or the unraveled twisted end) and pull it toward the open end 6, leave the desired amount of slack, and either pull the twisted end 8 through the slits 5 or pull the twisted end below and about the open end 6 and then force the fabric 7 through both slits 4 at approximately the same time.

Referring to FIG. 5, the fabric 7 is shown as very taut, but can be of any tension the user so desires. The advantage of having two locations of the fabric 7 secured is that it allows for more control of the location of the fabric 7 during cleaning. This allows the user to better apply force used in cleaning to the areas that are soiled.

Figure 6:
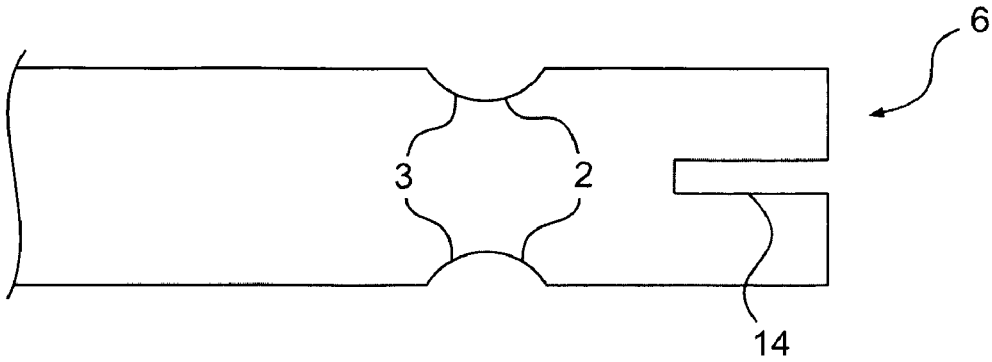
FIG. 6 shows an embodiment with fanning slits.
Figure 7:
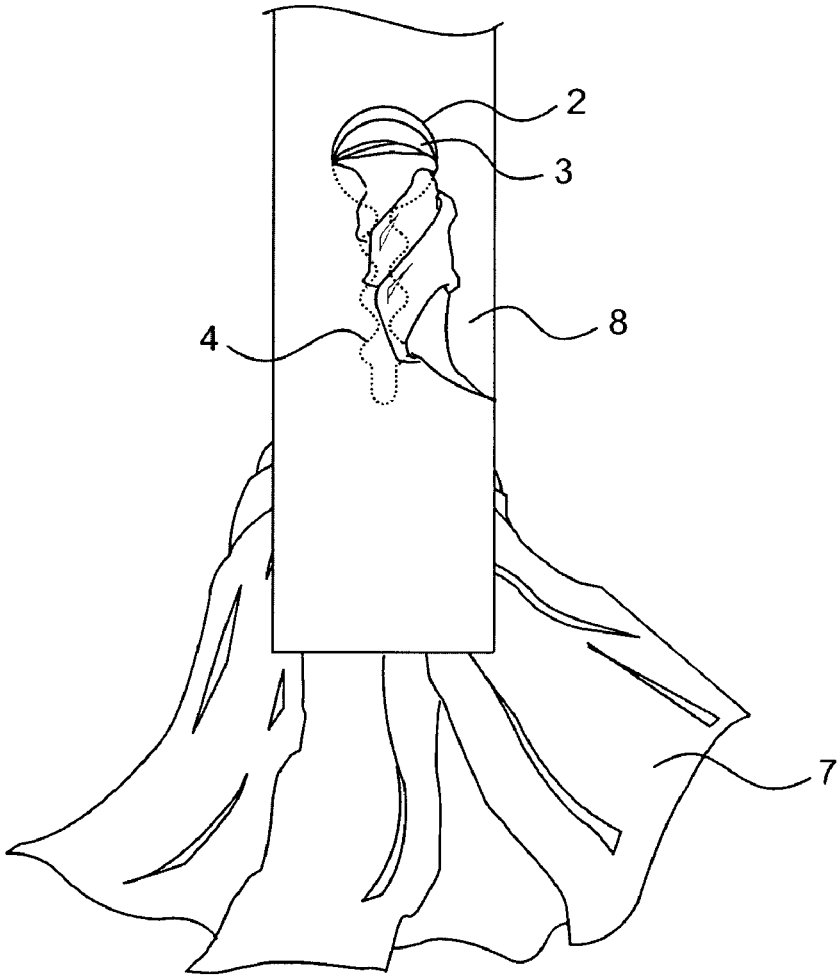
FIG. 7 shows fabric using the fanning slits.

Another embodiment is shown in FIGS. 6 and 7. This embodiment has fanning slits 14 that are not in communication with the apertures 2 and 3. As shown in FIG. 7, this allows the fabric 7 to spread out through the fanning slits 14. This allows more of the fabric to be used in the cleaning process by allowing it to start fanning out at a much earlier point that if there where no fanning slits. It also helps keep the fabric fanned out, keeping a defined application surface, by positioning and keeping the fabric in the fanning slits 14. There can be one or more fanning slits 14 and can be of any orientation relative to one or more other fanning slits 14.

This embodiment can employ a sleeve 11 (not shown) like the one described above. The sleeve for this embodiment can also have slits that correspond to the fanning slits 14. The sleeve 11 will assist in fanning out the fabric 14 and securing the twisted end 8 of the fabric. The sleeve can run on a set path so that the fanning slits 14 will correspond to the slits in the sleeve.

The embodiment can also have slits 4 (shown in shadow in FIG. 7) in the manner discussed above. The slits 4 may also have projections as discussed above.

Embodiments with alternative designs for the same identified parts are contemplated to be employed or interchanged with all other embodiments.

Numerous modifications and alternative arrangements may be devised by those skilled in the art without departing from the spirit and scope of the present invention and the present invention is intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function, manner of operation, assembly, and use may be made without departing from the principles and concepts set forth herein.

I claim:

1. A cleaning device comprising:

a shaft with longitudinal axis, wherein the shaft comprises:

a hollow section;

a lower end with a rim;

the rim defines an opening at the proximate end of the shaft;

wherein said opening is located about the longitudinal axis and is in communication with said hollow section;

one or more apertures that extend through the side of the shaft and are in communication with said hollow section;

one or more slits; and wherein a cleaning element is located within the opening.

2. The cleaning device of claim 1, wherein the one or more slits has one or more projections.

3. The cleaning device of claim 2, wherein at least one of said apertures is in direct communication with one of the one or more slits.

4. The cleaning device of claim 1, wherein the shaft has a sleeve; and wherein when the sleeve is in a secured position, a portion of the sleeve is over the one or more apertures.

5. The cleaning device of claim 4, wherein the sleeve, when in the secured position, extends to at least the rim.

6. The cleaning device of claim 5, wherein the sleeve, when in the secured position, is capable of applying pressure to any portion of a flexible material that extends out from the one or more apertures.

7. The cleaning device of claim 6, wherein the sleeve is permanently positioned about the longitudinal axis.

8. The cleaning device of claim 6, wherein the sleeve, when in the secured position, is attached to the shaft by a mechanical fastening means or frictional engagement.

9. The cleaning device of claim 1, wherein the device is constructed of plastic, wood, metal, ceramics, recycled materials or any combination thereof.

10. The cleaning device of claim 1, wherein the apertures are located at least 2 cm from the rim.

11. The cleaning device of claim 1, wherein the one or more slits have a width of 1 mm or more.

12. The cleaning device of claim 2, wherein the one or more slits narrows at a constant or irregular rate or any combination thereof.

13. The cleaning device of claim 1, wherein the cleaning element comprises a twisted end of one or more pieces of paper towels, wet wipes, cloth, or any flexible material suitable or designed for cleaning;

and wherein the cleaning device is capable of accepting the cleaning element through the rim, into the hollow part, through one of the one or more apertures.

14. The cleaning device of claim 2, wherein the one or more projections are wavy, irregular, offset, teeth like or any combination thereof.

15. The cleaning device of claim 4, wherein the cleaning element comprises a twisted end of one or more pieces of: paper towels, cloth, wet wipes, fabric, any flexible material suitable cleaning or any combination thereof and wherein the cleaning device is capable of accepting the cleaning element through the rim, into the hollow part, through one of the one or more apertures and through one or more of the slits; and wherein the sleeve is capable of sliding to the secured position.

16. The cleaning device of claim 1, wherein the shaft is circular, oblong, square or any geometric shape and size that is capable of accepting a twisted end of one or more pieces of paper towels, cloth, or any flexible material suitable or designed for cleaning into the shaft's proximal end.

17. The cleaning device of claim 5, wherein the sleeve is capable of increasing the contact surface of the flexible material with a surface upon which the cleaning device is being used.

18. The cleaning device of claim 6 wherein the sleeve comprises a joint and is capable of pivoting.

19. The cleaning device of claim 5, wherein the sleeve comprises one or more parts and is capable of being secured about the shaft.

20. The cleaning device of claim 1, wherein the one or more slits terminate before reaching the rim.

21. The cleaning device of claim 4, wherein the sleeve has slots corresponding the one or more slits in the shaft capable of allowing fabric present in the slits to extend through and past the shaft when the sleeve is in the secured position.

* * * * *